United States Patent [19]

Slayton

[11] Patent Number: 5,000,154

[45] Date of Patent: Mar. 19, 1991

[54] PRE-COCKING ASSEMBLY FOR USE WITH A COMPOUND ARCHERY BOW

[76] Inventor: James R. Slayton, 106 Duncan Dr. SW., Cartersville, Ga. 30120-5847

[21] Appl. No.: 530,274

[22] Filed: May 30, 1990

[51] Int. Cl.[5] ..... F41B 5/00

[52] U.S. Cl. ..... 124/23.1; 124/25.6; 124/35.2; 124/88

[58] Field of Search ..... 124/23.1, 24.1, 25, 124/25.6, 35.2, 86, 88

[56] References Cited

U.S. PATENT DOCUMENTS

| | | | |
|---|---|---|---|
| 2,664,078 | 12/1953 | Irwin | 124/86 X |
| 3,512,512 | 5/1970 | Wentz | 124/24.1 |
| 3,561,418 | 2/1971 | Fredrickson | 124/24 R |
| 3,895,621 | 7/1975 | Kellogg | 124/35.2 X |
| 4,061,125 | 12/1977 | Trotter | 124/23.1 |
| 4,603,676 | 8/1986 | Luoma | 124/25 |
| 4,615,326 | 10/1986 | Rathbun | 124/88 |
| 4,696,281 | 9/1987 | Nishioka | 124/25 |

*Primary Examiner*—Randolph A. Reese
*Assistant Examiner*—John Ricci
*Attorney, Agent, or Firm*—Terry M. Gernstein

[57] ABSTRACT

A pre-cocking assembly is mounted on a compound archery bow using fastener holes existing in most compound archery bows and keeps the bow string in a partially cocked position until the archer moves that string into a fully cocked position. The assembly then swings out of the way of the plane of the bowstring to be out of the archer's vision.

6 Claims, 2 Drawing Sheets

PRE-COCKING ASSEMBLY FOR USE WITH A COMPOUND ARCHERY BOW

TECHNICAL FIELD OF THE INVENTION

The present invention relates to the general art of amusement devices, and to the particular field of archery equipment.

BACKGROUND OF THE INVENTION

Archery bows, by their very nature, are physically difficult to cock, aim and fire due to a large tension of the bow string. When hunting for game, it is a frequent occurrence that between the time a hunter sights the game and properly cocks the bow, the game has disappeared.

Therefore, many hunters are forced to hold the bow in a partially cocked condition for great periods of time. This causes great stress on the hunter's muscles, and concomitantly can interfere with the hunter's aim. This is especially true of a compound bow which may be extremely difficult to cock.

A cross bow can be mechanically locked in a cocked position; however, cross bows are illegal in many areas.

Therefore, the art has included devices which can be used in conjunction with a long bow-type weapon to keep that weapon in a partially cocked position. However, these devices are often cumbersome to set and do not react quickly enough to completely satisfy the needs of a skilled hunter, especially if the game is quick at hiding. Some of the known devices may even interfere with the hunter's sight after they have released the bow string. This will create further drawbacks and problems.

Therefore, there is a need for a pre-cocking assembly which can be used on a compound archery bow and which will reliably hold the bow string thereof in a partially cocked configuration, yet which will quickly and reliably release that bow string, and will quickly move completely out of the way after releasing the bow string.

OBJECTS OF THE INVENTION

It is a main object of the present invention is to provide a pre-cocking assembly which can be used on a compound archery bow.

It is another object of the present invention to provide a pre-cocking assembly which can be used on a compound archery bow and which will reliably hold the bow string thereof in a partially cocked configuration.

It is another object of the present invention to provide a Pre-cocking assembly which can be used on a compound archery bow and which will reliably hold the bow string thereof in a partially cocked configuration yet which will quickly and reliably release that bow string.

It is another object of the present invention to provide a pre-cocking assembly which can be used on a compound archery bow and which will reliably hold the bow string thereof in a partially cocked configuration yet which will quickly and reliably release that bow string, and will quickly move completely out of the way after releasing the bow string.

SUMMARY OF THE INVENTION

These, and other, objects are achieved by a spring-operated re-cocking assembly that is mounted on a riser section of a compound archery bow. The assembly includes a swing arm that holds the bow string in a partially cocked position, and then moves in a horizontal plane and swings out of the way as soon as the bow string is moved from the partially cocked position towards the fully cocked position. The spring biases the swing arm towards an out-of-the way position, and the swing arm is held in the bow string-engaging position by the bow string itself.

With this assembly, the bow string can be quickly and easily placed into a partially cocked position, yet will be quickly and reliably released and the assembly will move out of the way so as not to interfere with the archer's aim or vision.

BRIEF DESCRIPTION OF THE DRAWING FIGURES

DETAILED DESCRIPTION OF THE PREFERRED EMBODIMENT OF THE INVENTION

Figure 1:
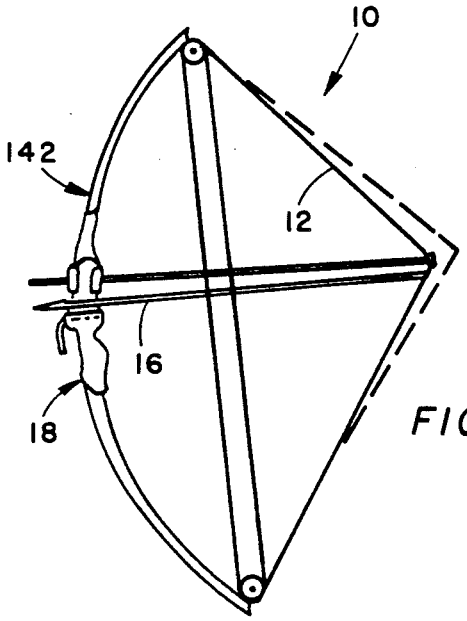
FIG. 1 is a side elevational view of a compound bow having a pre-cocking assembly of the present invention mounted thereon.

Shown in FIG. 1 is a compound archery bow 10 having a bowstring 12 attached to a backing section 14. The bow is used to fire an arrow 16. The string is shown in the partially cocked condition in full lines, and in a fully cocked position in phantom lines. As is well known to archers, the bow is held at a hand grip section 18, cocked and fired when desired.

Figure 2:
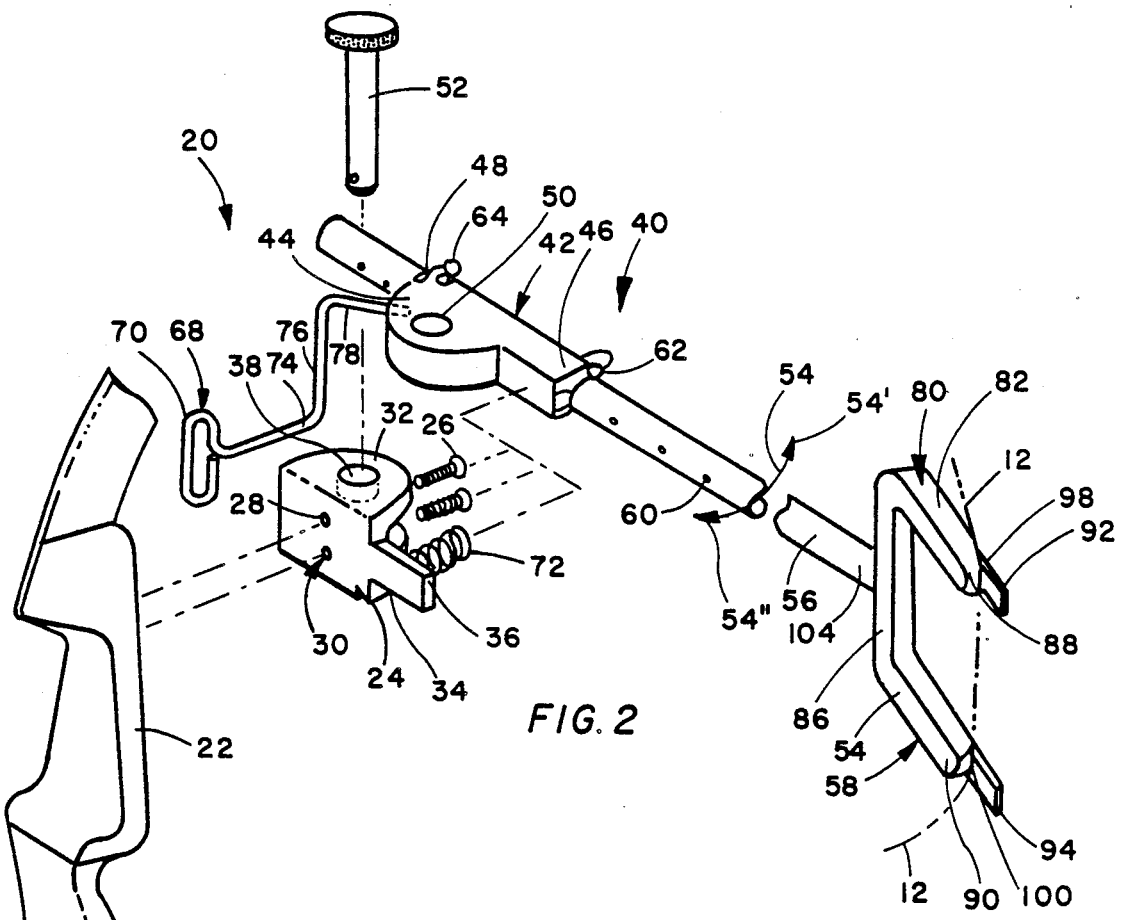
FIG. 2 is an exploded perspective view of the pre-cocking assembly of the present invention.

To permit an archer to hold the bow in a partially cocked position for long periods of time while waiting for game to come within shooting range or the like, the present invention is embodied in a pre-cocking assembly 20, best shown in FIG. 2.

The pre-cocking assembly is mounted on a riser 22 of the bow, and includes a clevis 24 attached to the riser by fasteners, such as screws 26 accommodated through holes 28 in a body section 30 thereof and attached to threaded holes defined in the riser. The clevis 24 includes two annular ears 32 and 34 which are spaced apart from each other and a tongue element 36 extending therefrom. Each ear has a hole, such as hole 38, defined therethrough and the holes 38 are aligned with each other.

A swing arm assembly 40 includes a sleeve element 42 having a lobar portion 44 near one end thereof, and a bore extending therethrough from one end 46 to another end 48 thereof. The lobar portion 44 has a hole 50 defined therethrough, and is received between the clevis annular ears 32 and 34 with the hole 48 aligned with the holes 38 of the clevis. A clevis bolt 52 fits through the aligned holes 38 and 50 to pivotably attach the swing arm to the bow via the clevis. Once attached, the swing arm moves in the directions indicated by double-headed arrow 54.

The swing arm further includes a rod 56 received in the sleeve bore and having a stirrup-shaped yoke element 58 on a distal end thereof. A plurality of holes 60 are defined through the rod at locations that are spaced apart along the longitudinal axis of that rod. Cotter keys 62 and 64 are positioned in selected ones of the holes 60 adjacent to each end of the sleeve to hold the rod in position in the sleeve.

The swing arm is moved under the influence of a lever 68 attached at one end thereof to the lobar portion of the sleeve and having a finger-engaging section 70 on another end thereof, and under the influence of a spring 72 fixedly mounted at one end thereof on the tongue element 36 and having the other end thereof abuttingly engaged against the sleeve adjacent to the sleeve end 46.

The lever is bent in two planes to form a Z-shape with two legs 74 and 76 in one plane and a third leg 78 in a second plane. The legs 74 and 76 intersect at a right angle, and the third leg 78 intersects the leg 76 to form a skewed angle with a plane containing legs 74 and 76. The lever is sized to position the finger-engaging portion 70 closely adjacent to the bow handgrip section 20 when the swing arm is in a non-bow string engaging Position while the bow string is being cocked. This will permit an archer to move the swing arm by extending the fingers of the bow gripping hand into engagement with the lever finger-engaging portion 70 and moving the swing arm by moving the lever with those fingers.

The spring 72 biases the swing arm in the direction 54', that is, away from bow string engagement, and is thus compressed when the bow string is held in the partially cocked position by the assembly 20.

The yoke-like element 58 is adapted to releasably hold a bow string, and includes a y-shaped section 80 having two legs 82 and 84 attached to a bight section 86 and extending parallel to each other to distal ends 88 and 90, respectively. The distal ends are rounded and tines 92 and 94 extend outwardly beyond these rounded ends. The tines include a planar surface 96 located adjacent to the rounded distal ends, and the intersection of the rounded distal portions with the planar tines forms notches 98 and 100. The bow string 12 is held in these notches when the yoke engages the bow string. The notches diverge outwardly away from the tines so that the notch "opens" in the direction 54". This facilitates placement of the bow string into the notches.

It is noted that the assembly 20 is shown for a right-handed archer, and would be reversed for a left handed-archer.

In operation, the assembly is mounted on the bow, and unless engaged with the bow string, will extend out of the plane containing the bow string so that it is out of the way of operation of that bow string. To use the assembly, the archer simply moves the bow string into a nearly cocked position, that is a position between the full line and the phantom line positions shown in FIG. 1, moves his fingers off of the bow and outwardly thereof and against the lever arm finger-engaging portion 70 to move the swing arm in direction 54" toward the plane containing the bow and the bow string until the yoke notches are in a position adjacent to the partially cocked bowstring. The bowstring is gently released and guided into the notches, and then can be fully released. The pressure of the bow string against the swing arm will prevent the spring 72 from moving that swing arm in the direction 54'.

To release the assembly, the archer simply has to move the bowstring from the partially cocked position shown in full lines in FIG. 1 to a fully cocked position shown in phantom lines in FIG. 1, and the bias exerted by spring 72 moves the swing arm in direction 54' out of the plane of the bow and bow string. The arm thus moves away from a bow string holding position, and frees the bow string for action.

The draw length, or the amount of distance of the bow string from the bow element 14 in the pre-cocked position, is set by moving the rod 56 in the bore of the sleeve until the length thereof as measured between the notches and the sleeve end 46 is set to establish a desired distance between the bow string and the bow element in the pre-cocked position. This length is set by means of the cotter keys 62 and 64 inserted into selected ones of the holes 60 of the rod. It is also noted that many compound bows already have holes defined in the riser section thereof so that these bows need not be unduly modified to accept the assembly 20. Thus, set up and knock down of the assembly are both quite easy and expeditious.

The yoke section 58 is in a plane that is at an angle with respect to a plane containing the longitudinal axis of the rod so that the swing arm is in a bow string freeing position, even during engagement with the bow string. This will facilitate rapid and reliable release of the bow string. In the preferred embodiment this angle, indicated in FIG. 2 by the reference numeral 104 is about twenty degrees; whereas the rounded distal ends of the yoke arms form thirty degree angles with the tines.

The assembly parts can be manufactured of any suitable materials, such as graphite, lightweight aluminum, titanium or the like.

Figure 3:
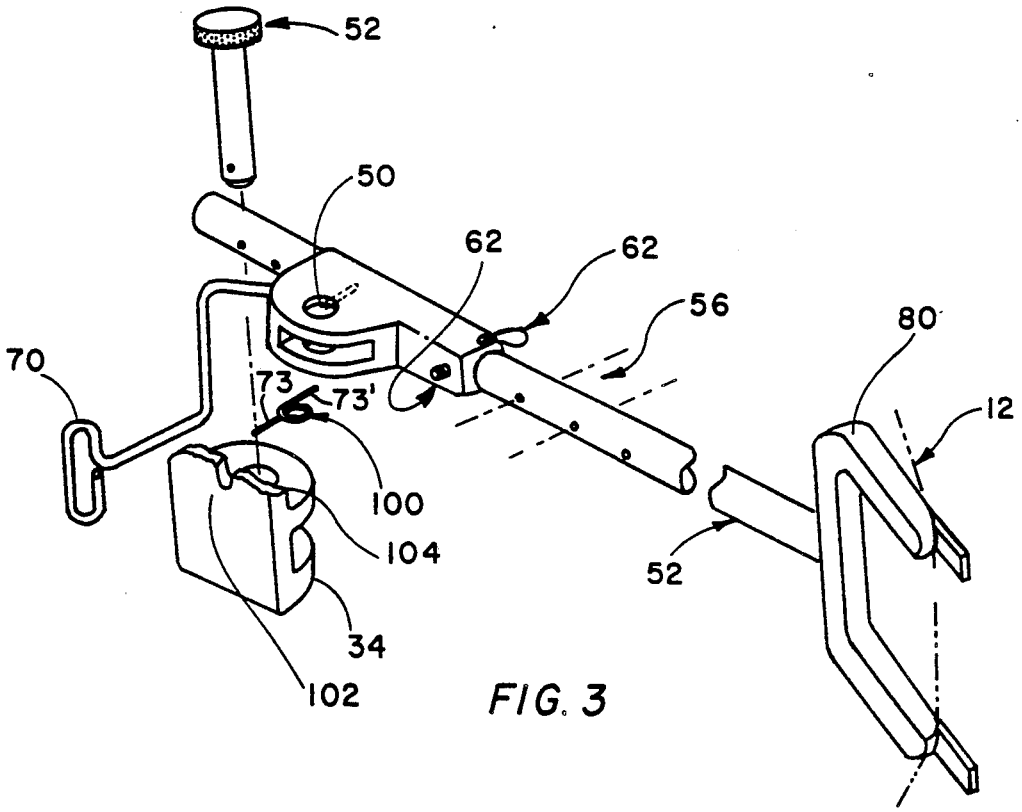
FIG. 3 is an exploded perspective view of an alternative embodiment of the pre-cocking assembly.
Figure 4:
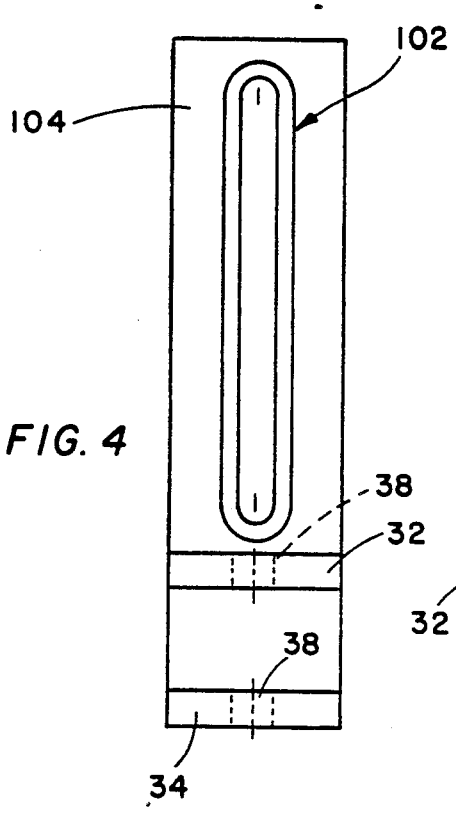
FIG. 4 is a front elevational view of clevis of the device.
Figure 5:
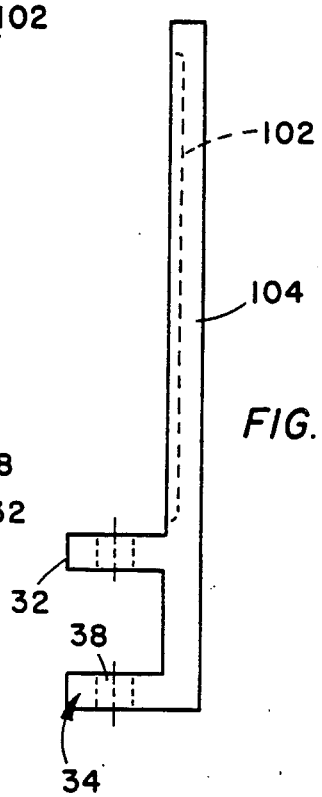
FIG. 5 is a side elevational view of the clevis.

Shown in FIGS. 3–5 is an alternative form of the device of the present invention. This form of the invention is slightly more versatile than the above-discussed form, and has a cleaner look to it.

The form shown in FIGS. 3–5 is identical to the form of the device shown in FIGS. 1 and 2 with the exception of a torsion spring 100 that replaces the compression spring 72 and which surrounds the pivot pin 52 and biases the device in the manner of the spring 72 as above discussed. The torsion spring includes ends 73 and 73' which are seated on the clevis and the sleeve element 42, respectively. The FIG. 3–5 form also includes an elongated slot 102 defined in a long leg 104 of the clevis. The fastener elements 26 attach the clevis to the bow riser via the elongated slot 102. For the sake of clarity, the long leg 104 is shown in FIG. 3 in cut-away form; however, the full leg is shown in FIGS. 4 and 5. This slot permits adjustments in position of the clevis so the user can make maximum use thereof.

It is understood that while certain forms of the present invention have been illustrated and described herein, it is not to be limited to the specific forms or arrangements of parts described and shown.

I claim:

1. A pre-cocking assembly for attachment to a compound archery bow comprising:

(A) a clevis element mounted on a riser section of a compound archery bow, said clevis element including (1) a body having two spaced apart annular ears with a bore defined through each ear, (2) a tongue on said clevis body, (3) a compression spring fixedly mounted at one end thereof on said tongue, and (4) fastening means attaching said clevis element to the riser section;

(B) a sleeve element pivotably mounted on said clevis element and including (1) a tubular body having a bore defined therethrough,
(2) a lobar portion on said tubular body,
(3) a bore being defined through said lobar portion in position to be aligned with said clevis bores when said lobar portion is located between said annular ears, and
(4) a spring-engaging portion on said tubular body in position to be abuttingly engaged by another end of said spring;

(C) a clevis bolt pivotably attaching said sleeve element to said clevis element;

(D) a lever element including
(1) one end fixedly attached to said sleeve lobar portion,
(2) a body which is bent in two directions and in two planes, and
(3) a finger-engaging portion on another end of said lever element;

(E) a rod element mounted on said sleeve and including
(1) a body slidably mounted in said sleeve bore,
(2) a plurality of fastener receiving holes being defined through said rod element at locations that are spaced apart from each other,
(3) a bow string engaging element on one end of said rod and including
(a) a bight section attached to said rod,
(a) two arms extending from said bight section,
(c) each of said arms including
(i) a proximal end attached to said bight section,
(ii) a distal end spaced from said proximal end,
(iii) a curved surface on said distal end, and
(iv) a tine located adjacent to said distal end, and having a planar surface located adjacent to said curved surface, said curved surface intersecting said planar surface at an angle to form a bow string receiving notch; and (F) fasteners received through said rod fastener-receiving holes adjacent to said sleeve for preventing said rod from sliding in said sleeve bore.

2. The pre-cocking assembly defined in claim 1 wherein said bow string-engaging element arms are coplanar-with each other and are in a plane that is at a skewed angle to a plane containing said rod.

3. The pre-cocking assembly defined in claim 2 wherein said skewed angle is twenty degrees.

4. The pre-cocking assembly defined in claim 3 wherein said curved surface intersects said tine planar surface at an angle of thirty degrees.

5. The pre-cocking assembly defined in claim 4 wherein said lever element includes two legs that intersect each other at a right angle and a define a plane, and a third leg that has one end intersecting one of said two legs and forms a skewed angle with the plane formed by said two legs, said third leg having another end engaging said lobar portion.

6. A pre-cocking assembly for attachment to a compound archery bow comprising:

(A) a clevis element mounted on a riser section of a compound archery bow, said clevis element including
(1) a body having two spaced apart annular ears with a bore defined through each ear,
(2) a long leg on said clevis body, said long leg including an elongated slot defined therein,
(3) a torsion spring fixedly mounted at one end thereof on said body, and
(4) fastening means attaching said clevis element to the riser section via said elongated slot;

(B) a sleeve element pivotably mounted on said clevis element and including
(1) a tubular body having a bore defined therethrough,
(2) a lobar portion on said tubular body,
(3) a bore being defined through said lobar portion in position to be aligned with said clevis bores when said lobar portion is located between said annular ears, and
(4) a spring-engaging portion on said tubular body in position to be abuttingly engaged by another end of said torsion spring;

(C) a clevis bolt pivotably attaching said sleeve element to said clevis element;

(D) a lever element including
(1) one end fixedly attached to said sleeve lobar portion,
(2) a body which is bent in two directions and in two planes, and
(3) a finger-engaging portion on another end of said lever element;

(E) a rod element mounted on said sleeve and including
(1) a body slidably mounted in said sleeve bore,
(2) a plurality of fastener-receiving holes being defined through said rod element at locations that are spaced apart from each other,
(3) a bow string engaging element on one end of said rod and including
(a) a bight section attached to said rod,
(a) two arms extending from said bight section,
(c) each of said arms including
(i) a proximal end attached to said bight section,
(ii) a distal end spaced from said proximal end,
(iii) a curved surface on said distal end, and
(iv) a tine located adjacent to said distal end, and having a planar surface located adjacent to said curved surface, said curved surface intersecting said planar surface at an angle to form a bow string receiving notch; and (F) fasteners received through said rod fastener-receiving holes adjacent to said sleeve for preventing said rod from sliding in said sleeve bore.

* * * * *